US005307075A

United States Patent [19]

Huynh

[11] Patent Number: 5,307,075

[45] Date of Patent: Apr. 26, 1994

[54] DIRECTIONAL MICROSTRIP ANTENNA WITH STACKED PLANAR ELEMENTS

[75] Inventor: Tan D. Huynh, Arlington, Tex.

[73] Assignee: Allen Telecom Group, Inc., Dallas, Tex.

[21] Appl. No.: 995,335

[22] Filed: Dec. 22, 1992

Related U.S. Application Data

[63] Continuation of Ser. No. 806,733, Dec. 12, 1991, abandoned.

[51] Int. Cl.[5] ..... H01Q 1/38

[52] U.S. Cl. ..... 343/700 MS; 343/829; 343/846; 343/853

[58] Field of Search ..... 343/700 MS, 829, 830, 343/846, 847, 848, 833, 853; H01Q 1/38

[56] References Cited

U.S. PATENT DOCUMENTS

| | | | |
|---|---|---|---|
| Re. 29,911 | 2/1979 | Munson | 343/700 |
| Re. 32,369 | 3/1987 | Stockton et al. | 342/368 |
| 3,921,177 | 11/1975 | Munson | 343/846 |
| 4,012,741 | 3/1977 | Johnson | 343/700 |
| 4,070,676 | 1/1978 | Sanford | 343/700 |
| 4,131,892 | 12/1978 | Munson et al. | 343/700 |
| 4,131,893 | 12/1978 | Munson et al. | 343/700 |
| 4,131,894 | 12/1978 | Schiavone | 343/700 |
| 4,218,682 | 8/1980 | Yu | 343/700 MS |
| 4,320,401 | 3/1982 | Schiavone | 343/700 |
| 4,442,590 | 4/1984 | Stockton et al. | 29/571 |
| 4,464,663 | 8/1984 | Lalezari et al. | 343/700 |
| 4,477,813 | 10/1984 | Weiss | 343/700 |
| 4,660,048 | 4/1987 | Doyle | 343/700 MS |
| 4,684,952 | 8/1987 | Munson et al. | 343/700 |
| 4,686,535 | 8/1987 | Lalezari | 343/700 |
| 4,719,470 | 1/1988 | Munson | 343/700 |
| 4,736,454 | 4/1988 | Hirsch | 455/129 |
| 4,816,836 | 3/1989 | Lalezari | 343/700 |
| 4,821,040 | 4/1989 | Johnson et al. | 343/700 |
| 4,835,538 | 5/1989 | McKenna et al. | 343/700 MS |
| 4,835,539 | 5/1989 | Paschen | 343/700 |
| 4,835,541 | 5/1989 | Johnson et al. | 343/713 |
| 4,914,445 | 4/1990 | Shoemaker | 343/700 MS |
| 5,010,348 | 4/1991 | Rene et al. | 343/700 MS |
| 5,061,944 | 10/1991 | Powers et al. | 343/795 |

*Primary Examiner*—Donald T. Hajec
*Assistant Examiner*—Hoanganh Le
*Attorney, Agent, or Firm*—Dressler, Goldsmith, Shore, Sutker & Milnamow, Ltd.

[57] ABSTRACT

A monolithically loaded microstrip antenna is provided for a communications function, such as a cellular telephone base station. The antenna includes a ground plane and a group of stacked, planar elements. A director element having a rectangular configuration together with monolithic load tabs is connected to a feed line and spaced above the ground plane. A first director element is spaced above the driven element and has lesser length and width dimensions than the driven element. A second director element is spaced above the first director element and likewise has lesser length and width dimensions than the driven element. A group of eight of the antennas are positioned in a column to form an antenna array which has substantial vertical polarization, a relatively wide horizontal beam width, approximately 60° and a relatively narrow vertical beam width, approximately 8.0°. The antenna array has a center frequency of 885 Mhz and a bandwidth of approximately 230 Mhz.

61 Claims, 2 Drawing Sheets

DIRECTIONAL MICROSTRIP ANTENNA WITH STACKED PLANAR ELEMENTS

This application is a continuation of application Ser. No. 07/806,733, filed Dec. 12, 1991, now abandoned.

FIELD OF THE INVENTION

The present invention pertains in general to a microstrip type of antenna and in particular to such an antenna having multiple, stacked planar elements.

BACKGROUND OF THE INVENTION

Microstrip antennas have come into widespread application because of the compact size and ease of fabrication. The conventional microstrip antenna consists of a rectangular patch metal element positioned on a grounded dielectric substrate. The thickness of the substrate is typically much less than the wavelength at which the antenna operates. Microstrip antennas are particularly desirable for use in an antenna array. Microstrip antennas, for example, are shown in U.S. Pat. Nos. 4,835,538 to McKenna, 4,131,893 to Munson et al., 4,131,894 to Schiavone, and 4,821,040 to Johnson et al. A disadvantage of a typical microstrip antenna is its narrow bandwidth, typically 3% and low gain, such as 7.0 db. It would be desirable to maintain the advantages of a microstrip antenna while improving its bandwidth and gain.

A number of approaches have been made to improve the bandwidth of microstrip patch antennas, but little attention has been paid to improving the radiation characteristics, such as directivity and gain. A number of approaches have been made to broaden the antenna bandwidth of microstrip antennas. These are a thick dielectric substrate microstrip patch and a multi-layer parasitically coupled microstrip patch antenna.

A thick dielectric substrate microstrip patch antenna such as shown in U.S. Pat. No. 4,835,538 as FIG. 1 comprises a radiating patch fabricated on a relatively thick dielectric substrate. Such an antenna structure can produce a bandwidth of approximately 8% at 1.5:1 VSWR (voltage standing wave ratio).

One approach to improving the bandwidth of a microstrip patch antenna is a design in which one or more parasitic elements are employed to improve the antenna bandwidth. An example of such an antenna structure is a capacitively coupled resonator radiator shown in U.S. Pat. No. 4,835,538 as FIG. 2. This includes a stacked array of two elements with only the lowermost element being fed. RF (radio frequency) energy is radiated from the driven element to create currents that flow on the parasitic element, which is larger than the driven element. This antenna structure produces a maximum bandwidth of approximately 14% at 2:1 VSWR. This is insufficient in many applications. Further, the VSWR obtained in this design is too high for the output stages of many RF transceivers and this can result in system inefficiency due to excessive return loss.

A further example of a multi-layer parasitically coupled microstrip patch antenna is also shown in U.S. Pat. No. 4,835,528 as FIG. 4. This antenna includes a stacked array of three circular elements in which the lowermost element is fed. The lowermost element is the smallest and the upper parasitic elements are the largest. These elements are printed on copper clad printed circuit board and are separated and supported by honeycomb dielectric material. The bandwidth obtained from this type of antenna structure ranges from 20–30% at 2.0:1 VSWR or about 18% at 1.4:1 VSWR. This bandwidth is broader as compared to conventional microstrip patch antennas, but, this antenna structure has a dual linearally polarized radiation characteristic. As a result, the RF energy is radiated in both the vertical and horizontal polarizations and this is not applicable or suitable in many applications, such as radio communication systems, which use vertical polarization only.

An antenna structure which has stacked radiator elements is shown in U.S. Pat. No. 4,131,892 to Munson et al.

A microstrip antenna and array of microstrip antennas is described in U.S. Pat. No. Re. 29,911 to Munson.

In view of the above state of development for microstrip antennas and the requirements for antenna applications, such as radio communications for cellular telephones, there is a need for an antenna, and corresponding array of antennas, which has a substantial bandwidth, high radiation efficiency, a reproducible design for easy manufacture and high power handling capability. There is further a need to control the radiation sidelobes for an array of such antennas.

SUMMARY OF THE INVENTION

A selected embodiment of the present invention is a directional antenna of the microstrip type. Immediately above a ground plane, there is provided a planar, rectangular driven element which is spaced from the ground plane at a distance substantially less than the wavelength of the operating frequency for the antenna. A first planar, rectangular director element is positioned above the driven element and the first director element has length and width dimensions which are less than the respective length and width dimensions of the driven element. A second planar, rectangular director element is positioned above the first director element and has length and width dimensions which are less than the respective length and width dimensions of the driven element. The driven element and the two director elements are positioned to have a common axis. An RF feed line is connected to the driven element for transferring RF energy between the antenna and a communications device, such as a radio transceiver.

In a further aspect of the invention, rectangular tabs are provided on opposite sides of the driven element to function as a monolithic load for the antenna and to enhance the antenna bandwidth as well as to provide impedance matching between the antenna and operating devices, such as a transceiver. The ground plane, driven element and director elements are separated by cylindrical spacers, but the principal dielectric between these elements is air.

A further aspect of the present invention is an array of the described antennas oriented in a vertical column for providing a wide bandwidth, vertically polarized, high-gain array with a relatively narrow vertical beam width.

BRIEF DESCRIPTION OF THE DRAWINGS

For a more complete understanding of the present invention and the advantages thereof, reference is now made to the following description taken in conjunction with the accompanying drawings in which.

DETAILED DESCRIPTION OF THE INVENTION

Figure 1:
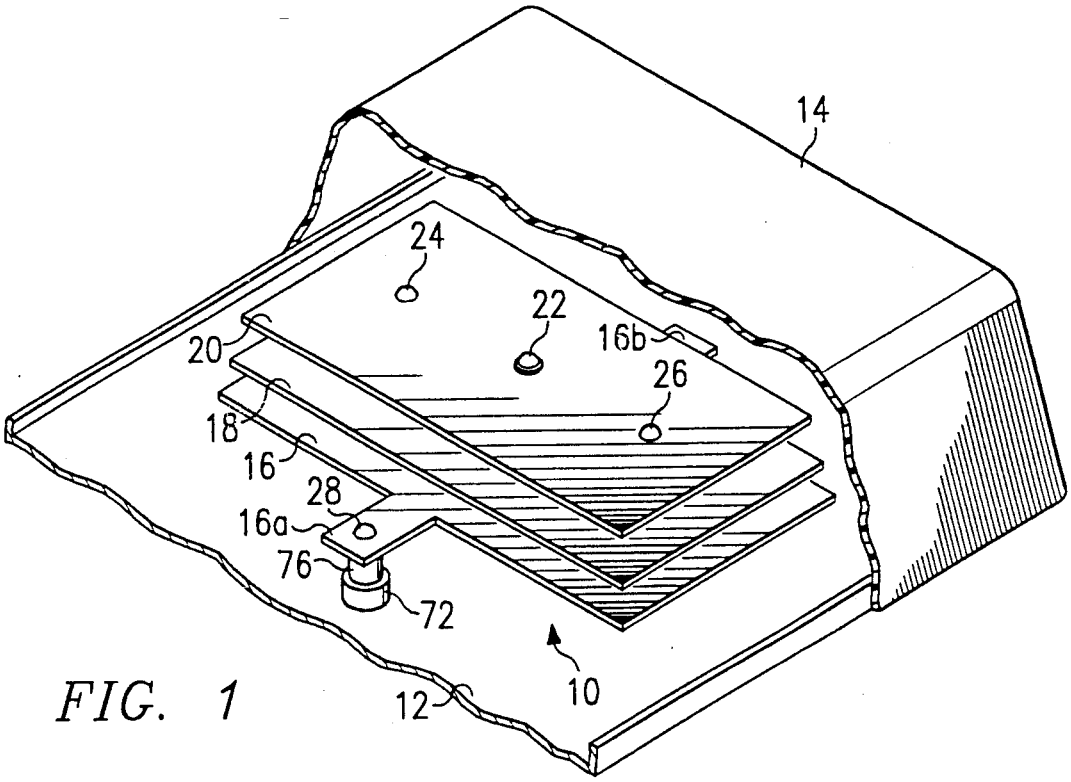
FIG. 1 is a perspective view of an antenna in accordance with the present invention.

An antenna and an array of antennas in accordance with the present invention is disclosed in the figures. Reference is first made to FIG. 1 in which an antenna 10 is shown mounted on an elongate ground plane 12. The ground plane 12 may be, for example, an aluminum plate. An enclosure 14 of dielectric material, such as plastic or fiberglass, is removably mounted to the ground plane 12 for protecting the antenna 10 and corresponding antennas in the antenna array, from the environment and other physical damage.

Figure 2:
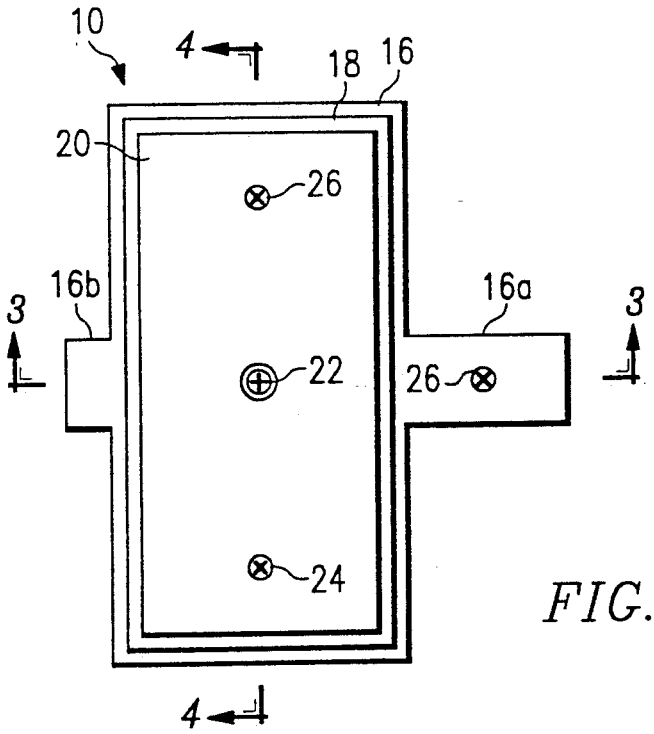
FIG. 2 is a plan view of the antenna shown in FIG. 1.
Figure 3:
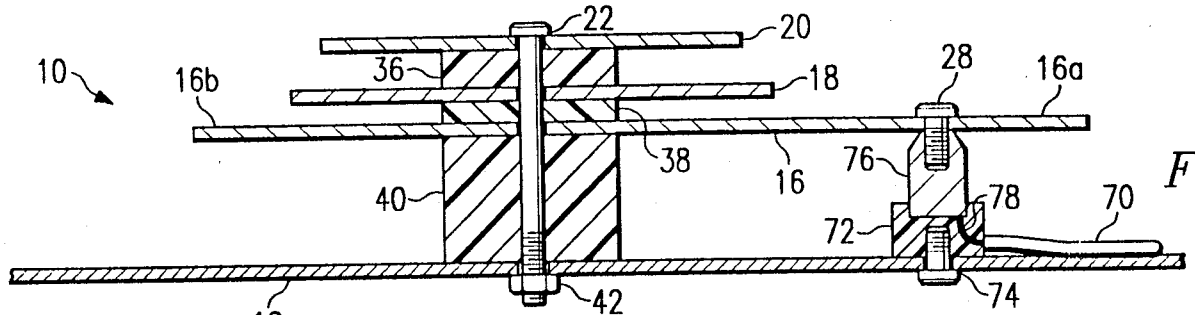
FIG. 3 is a section view taken along lines 3—3 of the antenna shown in FIG. 2.
Figure 4:
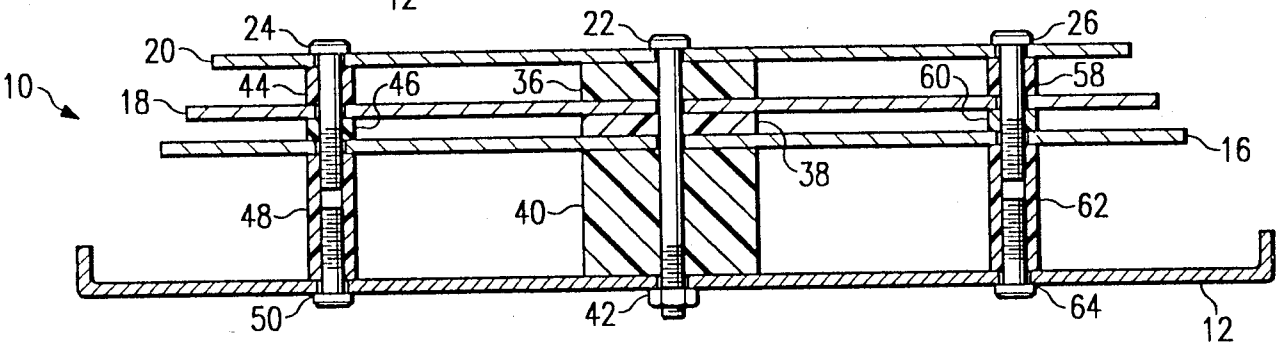
FIG. 4 is a section view taken along lines 4—4 of the antenna shown in FIG. 2.

The antenna 10 is further described in reference to FIG. 1 as well as to FIGS. 2, 3 and 4. The antenna 10 includes a lowermost driven element 16, a first director element 18 spaced above the driven element 16 and a second director element 20 spaced above the director element 18. The elements 16, 18 and 20 are essentially rectangular and preferably are sheet aluminum having a thickness of 0.030 inch. The driven element 16 includes rectangular tabs 16*a* and 16*b* which are connected on opposite sides along the long dimension of the driven element 16. The element 16 and tabs 16*a* and 16*b* are preferably fabricated as a single plate. The tabs 16*a* and 16*b* function as monolithic loads for the antenna and serve the function of impedance matching between an operating device, such as a transceiver, and the antenna 10.

The antenna 10 is held together and mounted to the ground plane 12 by bolts 22, 24 and 26. The tab 16*a* is further provided with a bolt 28 therethrough.

Further referring to FIGS. 2, 3 and 4, the bolt 22 extends sequentially through the director element 20, a cylindrical spacer 36, director element 18, cylindrical spacer 38, driven element 16, a cylindrical spacer 40 and the ground plane 12. A nut 42 is threaded to the bolt 22 for securing the elements 16, 18 and 20 to the ground plane 12.

The bolt 24 likewise extends through element 20, a spacer 44, element 18, a spacer 46, element 16 and is threaded to a spacer 48. A bolt 50 extends through the ground plane 12 and is threaded to the spacer 48 thereby securing, in conjunction with the bolt 24, the elements 16, 18 and 20 to the ground plane 12.

Bolt 26 likewise extends sequentially through element 20, a spacer 58, element 18, a spacer 60, element 16 and is threaded to a spacer 62. A bolt 64 extends through ground plane 12 and is threaded to the spacer 62 for securing, in conjunction with the bolt 26, the elements 16, 18 and 20 to the ground plane 12.

Bolts 24, 26, 50 and 64 are preferably made of plastic, such as Teflon or Delron.

A coaxial cable feed line 70, such as copper coaxial cable, is connected to the ground plane 12 and extends to a spacer cup 72. The cup 72 is secured to the ground plane 12 by a plastic bolt 74. A brass feed probe 76 rests within the spacer cup 72 and is secured to the tab 16*a* by the bolt 28. A center conductor 78 of the feed line 70 extends through the spacer cup 72 for connection to the feed probe 76 which is in turn is electrically connected to the tab 16 a of the driven element 16.

Figure 5:
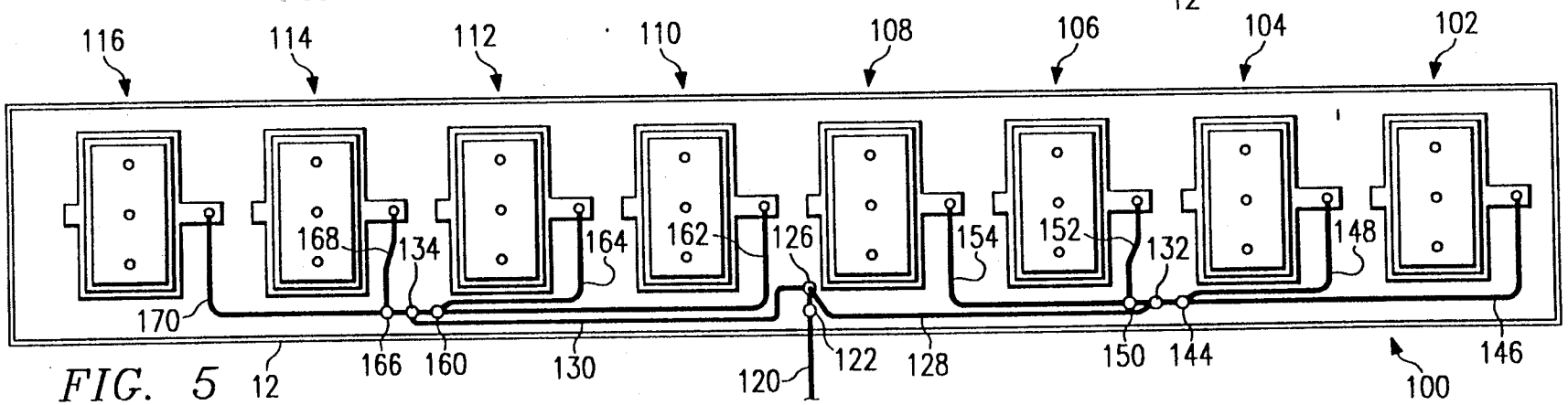
FIG. 5 is a plan view of an antenna array comprising a group of eight antennas, each essentially as illustrated in FIGS. 1-5.

Referring now to FIG. 5, there is illustrated an antenna array 100 comprising eight antennas 102, 104, 106, 108, 110, 112, 114 and 116. Each of the antennas 102-116 is essentially the same as the antenna 10 described above.

The array 100 is provided with a feed network which includes a primary feed line 120 that is connected to a RF transformer 122. The output from the RF transformer 122 is provided through a feed line to a power divider 126 which is connected through feed lines 128 and 130 to respective power dividers 132 and 134. The feed lines between the power divider 122 and the antennas 102-116 are termed secondary feed lines.

The power divider 132 is further connected to a power divider 144 which is in turn connected through feed lines 146 and 148 which couple, as shown in FIG. 3, to the antennas 102 and 104. The power divider 132 is further connected to a power divider 150 which is in turn connected to feed lines 152 and 154 that are respectively connected to antennas 106 and 108.

The power divider 134 is connected through a feed line to a power divider 160 which is in turn connected to feed lines 162 and 164 to respective antennas 110 and 112. The power divider 134 is further coupled through a feed line to a power divider 166 which is connected through feed lines 168 and 170 to respective antennas 114 and 116.

The feed lines shown in FIG. 5 can be implemented as copper coaxial cable or as microstrip circuitry on copper-clad dielectric. The latter implementation is more economical for an antenna produced in quantity.

The antenna 10 and array 100 described herein are designed to operate at a center frequency of approximately 885 Mhz with a bandwidth of approximately 230 Mhz at 1.5:1 VSWR. The described antenna, and array can be scaled to operate at other frequencies.

The preferred dimensions for the various elements of the antenna 10 are presented below:

| ELEMENT | DIMENSIONS |
|---|---|
| 16 | 7.63 in. × 4.88 in. |
| 16a | 2.75 in. × 1.50 in. |
| 16b | 1.72 in. × 1.06 in. |
| 18 | 7.19 in. × 4.69 in. |
| 20 | 6.88 in. × 4.44 in. |

The above-described dimensions are preferable for the antenna 10 shown in FIG. 1 as well as for the interior antennas 104, 106, 108, 110, 112 and 114 of the antenna array 100. To produce a better beam shape by suppressing side lobes, it is preferred that the dimensions of the outer antennas 102 and 116 of the array 100 be of slightly greater dimensions. These dimensions are as follows:

| ELEMENT | DIMENSIONS |
|---|---|
| 16 | 7.84 in. × 5.17 in. |
| 16a | 2.75 in. × 1.50 in. |
| 16b | 1.72 in. × 1.06 in. |
| 18 | 7.43 in. × 4.90 in. |
| 20 | 7.17 in. × 4.70 in. |

In general, each director element has approximately 90% of the width and length dimensions of the preceding element moving from the outer director toward the driven element. Additional director elements may be included in the antenna.

The combination of the driven element 16 and the director elements 18 and 20 function in a similar manner to that of a Uda-Yagi antenna, which is well known in the art.

In the described embodiment of the present invention, the spacing between the ground plane 12 and the driven element 16 is 0.94 inches, between the driven element 16 and the director element 18 is 0.35 inches and between the director element 18 and the director element 20 is 0.27 inches. The spacing, in general terms, between the driven element and first director element is approximately .15 of the wavelength of the center frequency of the antenna. This ratio can be used for scaling the antenna to other frequencies.

For each of the elements described above, that is, elements 16, 18 and 20, the ratio of length to width for each element is approximately 1.5. This is termed the "aspect ratio." This is a preferred ratio for construction of the antenna and antenna array of the present invention and also would be essentially followed in scaling the antenna to operate at other frequencies.

The spacers described above are preferably made of plastic material identified by the trademarks Teflon or Delron.

For the antenna 10, as well as the antennas 102–116, described above, the principal dielectric between the pairs of elements, including the ground plane, is air. This is the dielectric between the ground plane 12 and element 16, between element 16 and element 18 and between element 18 and element 20. The dielectric coefficient of air is appropriate for the operation of the antenna and the use of air instead of a dielectric, such as a honeycomb or foam material, is preferred because solid materials of this type tend to absorb moisture and thereby change the dielectric coefficient of the material thus altering the electrical properties of the antenna. The structural design of the present invention array permits the use of an air dielectric which provides a more electronically stable and lightweight antenna and antenna array.

Although several embodiments of the invention have been illustrated in the accompanying drawings and described in the foregoing Detailed Description, it will be understood that the invention is not limited to the embodiments disclosed, but is capable of numerous rearrangements, modifications and substitutions without departing from the scope of the invention.

What I claim is:

1. A directional antenna for producing a linearly polarized signal, comprising:

a ground plane, a planar, rectangular driven element offset from said ground plane, said driven element having first and second pairs of opposed sides, the length of said first pair of opposed sides being less than the length of said second pair of opposed sides;

a first planar, rectangular director element, said first director element being positioned offset from said driven element on the opposite side thereof from said ground plane, said first director element having first and second pairs of opposed sides, the length of said first pair of opposed sides being less than the length of said second pair of opposed sides, the length of the first pair of opposed sides of said first director element being less than the length of said first pair of opposed sides of said driven element, a second planar, rectangular director element, said second director element being positioned offset from said first director element on the opposite side thereof from said driven element, said second director element having first and second pairs of opposed sides, the length of said first pair of opposed sides being less than the length of said second pair of opposed sides, the length of the first pair of opposed sides of said second director element being less than the length of said first pair of opposed sides of said driven element, and an RF feed line connected to one side of said second pair of opposed sides of said driven element.

2. A directional antenna as recited in claim 1 wherein said ground plane and said driven element are separated by a first cylindrical dielectric spacer, said driven element and said first director element are separated by a second cylindrical dielectric spacer, and said first director element and said second director element are separated by a third cylindrical dielectric spacer.

3. A directional antenna as recited in claim 2 including a bolt extending through said cylindrical spacers for connecting together said driven element, said first director element, said second director element, and said ground plane.

4. A directional antenna as recited in claim 2 wherein the spacing between said driven element and said ground plane is greater than the spacing between said driven element and said first director element.

5. A directional antenna as recited in claim 4 wherein the spacing between said driven element and said ground plane is greater than the spacing between said driven element and said second director element.

6. A directional antenna as recited in claim 5 wherein the spacing between said driven element and said first director element is less than the spacing between said first director element and said second director element.

7. A directional antenna as recited in claim 1 wherein the ratio of length to width for each of said elements is approximately 1.5.

8. A directional antenna as recited in claim 1 wherein the spacing between each pair of said elements is substantially less than a wavelength for the frequency of operation of the antenna.

9. A directional antenna as recited in claim 1 wherein air is provided as a principal dielectric between each pair of adjacent ones of said ground plane and said elements.

10. A directional antenna as recited in claim 1 wherein said driven element, said first director element and said second director element are coaxial.

11. A directional antenna as recited in claim 1 wherein the length of the second pair of opposed sides of said first director element is less than the length of the second pair of opposed sides of said driven element.

12. A directional antenna as recited in claim 1 wherein the length of the second pair of opposed sides of said second director element is less than the length of the second pair of opposed sides of said driven element.

13. A directional antenna as recited in claim 1 wherein said first and second director elements correspond in shape to the shape of said driven element.

14. A directional antenna as recited in claim 13 wherein said first director element is smaller than said driver element, and said second director element is smaller than said first director element.

15. A directional antenna as recited in claim 1 wherein the length of the first pair of opposed sides of said second director element is less than the length of the first pair of opposed sides of said first director element.

16. A directional antenna as recited in claim 15 wherein the length of the second pair of opposed sides of said second director element is less than the length of the second pair of opposed sides of said first element.

17. A directional antenna as recited in claim 1 wherein the spacing between said driven element and said ground plane is greater than the spacing between said driven element and said first director element.

18. A directional antenna as recited in claim 17 wherein the spacing between said driven element and said ground plane is greater than the spacing between said driven element and said second director element.

19. A directional antenna as recited in claim 18 wherein the spacing between said driven element and said first director element is less than the spacing between said first director element and said second director element.

20. A monolithically loaded directional antenna for producing a linearly polarized signal, comprising:

a ground plane, a planar, rectangular driven element positioned offset from said ground plane, said driven element having two pairs of opposed sides of unequal length and opposed tabs extending outward from opposite sides of one of said opposed pairs of sides of said driven element, said tabs being coplanar with said driven element, and wherein said tabs are a radiating portion of said driven element, a first planar, rectangular director element, said first director element having two pairs of opposed sides of unequal length, said first director element being positioned offset from said driven element on the opposite side thereof from said ground plane, said shorter pair of sides of said first director element being shorter than the shorter pair of sides of said driven element, a second planar, rectangular director element, said second director element having two pairs of opposed sides of unequal length, said second director element being positioned offset from said first director element on the opposite side thereof from said driven element, said shorter pair of sides of said second director element being shorter than the shorter pair of sides of said driven element, and an RF feed line connected to one of said tabs of said driven element.

21. A monolithically loaded directionally antenna as recited in claim 20 wherein said first director element is smaller than said driven element.

22. A monolithically loaded directional antenna as recited in claim 21 wherein said second director element is smaller than said driven element.

23. A monolithically loaded directional antenna as recited in claim 22 wherein said second director element is smaller than said first director element.

24. A monolithically loaded directional antenna as ecited in claim 20 wherein said tabs are formed as an integral part of and extend out from the opposite sides of the longer pair of said opposed sides of said driven element.

25. A monolithically loaded directional antenna as recited in claim 24 wherein one of said tabs is larger than the other of said tabs.

26. A monolithically loaded directional antenna as recited in claim 25 wherein said RF feed line is connected to said larger one of said tabs of said driven element.

27. A monolithically loaded directional antenna as recited in claim 24 wherein one of said tabs is longer than the other of said tabs.

28. A monolithically loaded directional antenna as recited in claim 27 wherein said RF feed line is connected to said longer one of said tabs of said driven element.

29. A monolithically loaded directional antenna as recited in claim 24 wherein the spacing between said driven element and said ground plane is greater than the spacing between said driven element and said first director element.

30. A monolithically loaded directional antenna as recited in claim 29 wherein the spacing between said driven element and said ground plane is greater than the spacing between said driven element and said second director element.

31. A monolithically loaded directional antenna as recited in claim 30 wherein the spacing between said driven element and said first director element is less than the spacing between said first director element and said second director element.

32. A monolithically loaded directional antenna as recited in claim 20 wherein said ground plane an said driven element are separated by a first cylindrical dielectric spacer, said driven element and said first director element are separated by a second cylindrical dielectric spacer, and said first director element and said second director element are separated by a third cylindrical dielectric spacer.

33. A monolithically loaded directional antenna as recited in claim 32 including a bolt extending through said cylindrical spacers for connecting together said driven element, said first director element and said second director element.

34. A monolithically loaded directional antenna as recited in claim 20 wherein said tabs are connected to the longer sides of said driven element.

35. A monolithically loaded directional antenna as recited in claim 20 wherein the ratio of length to width for each of said elements is approximately 1.5.

36. A monolithically loaded directional antenna as recited in claim 20 wherein the spacing between each pair of said elements is substantially less than a wavelength for the frequency of operation of the antenna.

37. A monolithically loaded directional antenna as recited in claim 20 wherein air is provided as a principal dielectric between each pair of adjacent ones of said ground plane and said elements.

38. A monolithically loaded directional antenna as recited in claim 20 wherein said driven element, said first director element and said second director element are coaxial.

39. A directional antenna array for producing a linearly polarized signal, comprising:

an elongate ground plane, a plurality of antennas, each comprising, a planar, rectangular driven element offset from said ground plane, said driven element having two pairs of opposed sides of unequal length;

a first planar, rectangular director element having two pairs of opposed sides of unequal length, said first director element being positioned offset from said driven element on the opposite side thereof from said ground plane, the shorter pair of sides of said first director element being shorter than the shorter pair of sides of said driven element, a second planar, rectangular director element having two pairs of opposed sides of unequal length, said first director element being positioned offset from said first director element on the opposite side thereof from said driven element, the shorter pair of sides of said second director element being shorter than the shorter pair of sides of said driven element, and an RF network having a primary feed line coupled to a plurality of secondary feed lines which are respectively connected to one side of the longer pair of opposed sides of the driven elements for each of said antennas.

40. A directional antenna array as recited in claim 39 wherein there are eight of said antennas positioned in a column.

41. A directional antenna array as recited in claim 39 wherein for each of said antennas said ground plane and said driven element are separated by a first cylindrical dielectric spacer, said driven element and said first director element are separated by a second cylindrical dielectric spacer, and said first director element and said second director element are separated by a third cylindrical dielectric spacer.

42. A directional antenna as array recited in claim 41 including for each of said antennas a bolt extending through said cylindrical spacers for connecting together said driven element, said first director element and said second director element.

43. A directional antenna array as recited in claim 39 wherein the ratio of length to width for each of said elements is approximately 1.5.

44. A directional antenna array as recited in claim 39 wherein the spacing between each pair of said elements is substantially less than a wavelength for the frequency of operation of the antenna array.

45. A directional antenna array as recited in claim 44 wherein the spacing between each of said driven elements and said ground plane is greater than the spacing between each of said driven elements and a corresponding one of said first director elements.

46. A directional antenna array as recited in claim 45 wherein the spacing between each of said driven elements and said ground plane is greater than the spacing between each of said driven elements and a corresponding one of said second director elements.

47. A directional antenna array as recited in claim 46 wherein the spacing between each of said driven elements and the corresponding ones of said first director elements is less than the spacing between corresponding ones of said first director elements and the corresponding ones of said second director elements.

48. A directional antenna array as recited in claim 39 wherein for each of said antennas air is provided as a principal dielectric between each pair of adjacent ones of said ground plane and said elements.

49. A directional array as recited in claim 39 wherein for each said antenna, said driven element, said first director element and said second director element are coaxial.

50. A directional antenna array as recited in claim 39 wherein for each antenna said first director element is smaller than said driven element.

51. A directional antenna array as recited in claim 50 wherein for each antenna said second director element is smaller than said driven element.

52. A directional antenna array as recited in claim 51 wherein for each said antenna said second director element is smaller than said first director element.

53. A directional antenna array as recited in claim 52 wherein for each antenna said first and second director elements correspond in shape to the shape of said driven element.

54. A directional array as recited in claim 39 wherein said array has two outer ones of said antennas and the remainder are interior ones of said antennas and said elements of said outer ones of said antennas are larger than said elements of the interior ones of said antennas.

55. A directional antenna array as recited in claim 39 wherein each antenna includes a set of rectangular tabs connected to one pair of opposed sides of each of said driven elements of said antennas for providing a pair of monolithic loads for each of said antennas, said tabs being radiating portions of said driven elements.

56. A directional antenna array as recited in claim 55 wherein for each antenna said tabs are connected to the longer sides of said driven element.

57. A directional antenna array as recited in claim 56 wherein for each antenna said tabs are formed as an integral part of and extend out from the opposite sides of the longer pair of said opposed sides of each of said driven elements.

58. A directional antenna array as recited in claim 57 wherein one of said tabs of each set is larger than the other of said tabs.

59. A directional antenna array as recited in claim 58 wherein said secondary feed lines are connected to said larger ones of said tabs of said driven elements.

60. A directional antenna array as recited in claim 57 wherein for each antenna one of said tabs of the set is longer than the other of said tabs.

61. A directional antenna array as recited in claim 60 wherein said secondary feed lines are connected to said longer ones of said tabs of said driven elements.

* * * * *